United States Patent [19]

Hildebrand

[11] Patent Number: 4,792,808

[45] Date of Patent: Dec. 20, 1988

[54] ELLIPSOID DISTRIBUTION OF ANTENNA ARRAY ELEMENTS FOR OBTAINING HEMISPHERIC COVERAGE

[75] Inventor: Robert C. Hildebrand, Indialantic, Fla.

[73] Assignee: Harris Corp., Melbourne, Fla.

[21] Appl. No.: 449,661

[22] Filed: Dec. 14, 1982

[51] Int. Cl.[4] ..... H01Q 21/00

[52] U.S. Cl. ..... 343/853; 343/754; 343/895

[58] Field of Search ..... 343/754, 895, 853

[56] References Cited

U.S. PATENT DOCUMENTS

| | | | |
|---|---|---|---|
| 2,761,138 | 8/1956 | Sherman | 343/762 |
| 3,152,330 | 10/1964 | Chatelain | 343/895 |
| 3,192,529 | 6/1965 | Chatelain | 343/895 |
| 3,230,536 | 1/1966 | Cheston | 343/754 |
| 3,594,802 | 7/1971 | Koob | 343/895 |
| 3,803,618 | 4/1974 | Coleman | 343/754 |
| 4,162,499 | 7/1979 | Jones et al. | 343/700 MS |

*Primary Examiner*—William L. Sikes
*Assistant Examiner*—Robert E. Wise
*Attorney, Agent, or Firm*—Antonelli, Terry & Wands

[57] ABSTRACT

The surface area utilization efficiency of an array of antenna elements distributed over a prescribed geometrical surface is increased by configuring that surface as an ellipse of revolution. Preferably, the ellipsoid surface over which the antenna elements are distributed has a shape such that the major axis of the ellipse in rotation is twice the length of the minor axis. This results in an optimal, near constant illuminated surface area for any angle in the hemisphere. Because a more efficient use of the antenna surface area is provided, the number of antenna elements that is required to obtain the same array gain in all directions in the hemisphere can be reduced substantially when compared with spherical or tetrahedral configurations of conventional hemispherical coverage arrays.

16 Claims, 1 Drawing Sheet

ELLIPSOID DISTRIBUTION OF ANTENNA ARRAY ELEMENTS FOR OBTAINING HEMISPHERIC COVERAGE

FIELD OF THE INVENTION

The present invention is directed to antenna array configurations and, in particular, to an improved element distribution that employs an ellipsoid (an ellipse of revolution) for obtaining substantially uniform hemispherical coverage.

BACKGROUND OF THE INVENTION

Phased array antennas are a commonly employed expedient for obtaining a prescribed antenna profile that may provide communication coverage over a defined surface area in space. For satellite communications, in particular, where coverage of the entire upper hemisphere is required, previously proposed arrays have involved multiple planar arrays configured as a tetrahedral arrangement or as a spherical or hemispherical dome. Exemplary illustrations of such hemispherical and spherical approaches are presented in the October 1981 issue of "Microwaves" and in a technical brief of the Aerospace Systems Division of Ball Brothers, entitled "Electrically Steerable Spherical Array, Executive Summary", October 1981.

Unfortunately, investigation has shown that a hemispherical array provides illumination of only one-half of the surface area at the horizon, while the entire surface area is illuminated at zenith. This results in an excess gain as the elevation angle increases, which is inherently inefficient. Tetrahedral arrays have similar problems at the intersections of the planes.

SUMMARY OF THE INVENTION

In accordance with the present invention the surface area utilization efficiency of an array of antenna elements distributed over a prescribed geometrical surface is increased by configuring that surface as an ellipsoid (an ellipse of revolution). In accordance with a preferred embodiment of the invention the ellipsoid surface over which the antenna elements are distributed has a shape such that the major axis of the ellipse in rotation is twice the length of the minor axis. This results in an optimal, near constant effective illuminated surface area for any angle in the hemisphere. Because a more efficient use of the antenna surface area is provided, the number of antenna elements that is required to obtain the same array gain in all directions in the hemisphere can be reduced substantially when compared with spherical or tetrahedral configurations of conventional hemispherical coverage arrays, thereby reducing both system cost and complexity.

DETAILED DESCRIPTION

Figure 1:
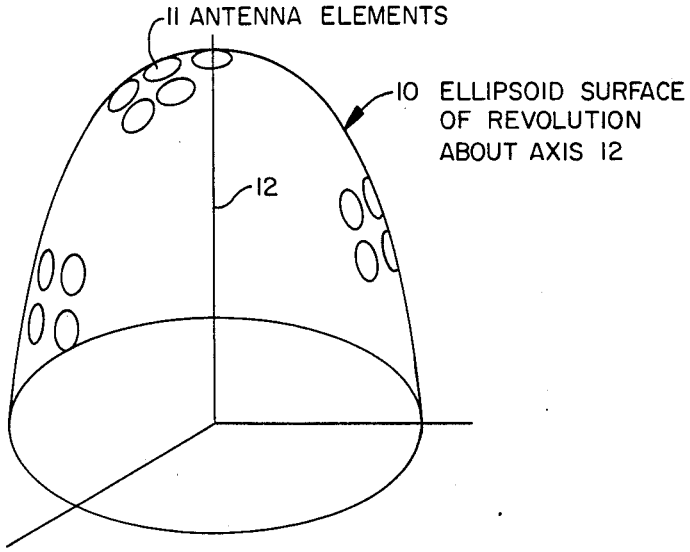
FIG. 1 shows a three dimensional view of a hemi-ellipsoid configured array of antenna elements.

Referring to FIG. 1, there is shown a perspective view of the antenna surface configuration of the present invention, in which an array of antenna elements 11 are distributed over a surface 10 having the shape of an ellipse of revolution. In FIG. 1, the axis about which the ellipse is rotated is denoted as the z-axis 12, with only a portion of the elements 11 being shown for purposes of clarity. It will be realized that for complete hemispherical coverage elements 11 are distributed over the entirety of surface 10. Preferably the spacing between adjacent elements is substantially uniform over the entire hemi-ellipsoid surface 10; however, if the spacing is too close, this may result in mutual overlap in the coverage profiles of individual elements. In the latter instance the spacing between elements is adjusted to prevent mutual interference as will be explained below.

In order to provide a complete understanding of the mechanism of the ellipsoid geometry of the array surface and the procedure for choosing element locations and spacing in the surface of a hemi-ellipsoid, as shown in FIG. 1, a description of the selection of ellipsoid characteristics for a practical example of the application of the present invention to satellite communications will be described with reference to the ellipse profile depicted in FIG. 2.

In the present example, the array of antenna elements 11 is oo provide complete satellite communication coverage for the hemisphere above the antenna (upper hemisphere) for sinnals at 2.0 GHz. The required G/T is selected to be such that the antenna gain must be a minimum of 10 dB. In general, the selection of an individual array element will be based on required bandwidth, efficiency, ease of fabrication, physical size, etc. The procedure described here applies generally to the class of elements whose transfer characteristic is predominately determined by the quantity of energy passing through some arbitrary surface (e.g. microstrip patch, spiral, horn feed, etc.)

Now the required effective illuminated area (A) for the upper hemisphere may be expressed as:

$$A = \frac{G \cdot \lambda^2}{4\pi\eta} \tag{1}$$

wherein:

G=required antenna gain $\eta$=array efficiency (effects of mutual coupling, element efficiency, etc.), and $\lambda$=signal wavelength.

Assuming a 65% efficiency for an individual array element, then substituting this and the above-chosen parametric values into equation (1) yields an illuminated area (A) of:

$$A = \frac{10 \times 15^2}{4\pi(.65)} \text{ cm}^2 = 275.46 \text{ cm}^2 \tag{2}$$

Figure 2:
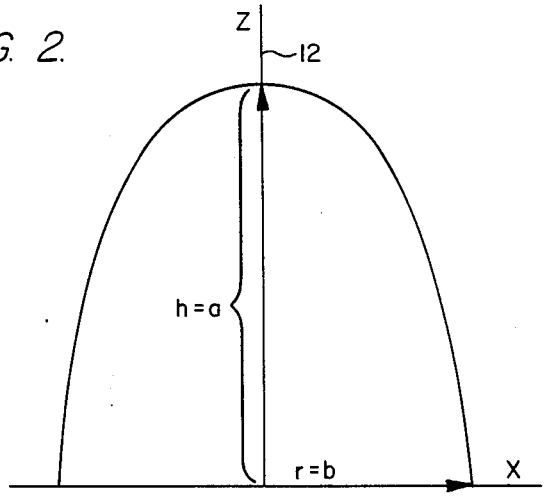
FIG. 2 shows a hemi-ellipse in the (x-z) plane for facilitating an understanding of the selected geometry, size and spacing of an antenna array in accordance with the present invention.

In FIG. 2, the height (h) or major axis length of the hemi-ellipse is denoted as "a" while the minor axis or radius (r) of the ellipsoid at its base (x-axis) is denoted by "b". As mentioned previously, in accordance with a preferred embodiment of the invention, the radius (r=b) of the base (or minor axis) of the ellipsoid is one-half the height (h=a) (or major axis). Using the area A of equation (2) for obtaining effective illuminated area A, then r can be derived by:

$$\pi r^2 = A = 275.46 \text{ cm}^2$$

$$\text{or } r = 9.365 \text{ cm} \tag{3}$$

Since the total surface area $A_t$ of a hemi-ellipse in rotation the major axis of which is twice its minor axis is defined by:

$$A_t = \pi r^2 + 4\pi r^2 \{\cos^{-1}(\tfrac{1}{2}) \cot [\cos^{-1}(\tfrac{1}{2})]\} \quad (4)$$

or $$A_t \simeq r^2 \times 10.74,$$

then substituting for r from equation (3), the total surface area obtained is $$A_t = 941.634 \text{ cm}^2 \quad (5)$$

For an individual one of elements 11, (assuming 0 dB isotropic coverage) the effective cell area $A_E$ is:

$$A_E = \lambda^2/4\pi\eta \text{ or } 27.546 \text{ cm}^2 \quad (6)$$

The number of elements Ne is now simply obtained by the ratio of these areas of $$Ne = \frac{941.634}{27.546} \cong 34.1 \text{ elements,}$$

so that a uniform distribution of 35 elements on the surface of the ellipsoid would satisfy the above-stated requirements. For a comparable dome configuration, the number of elements required is 39.91, or 40, while a tetrahedral array would require 59.8 or 60 elements. It can be seen, therefore, that the ellipsoid configuration of the invention offers a considerable savings in hardware cost.

As mentioned above, the relative proximity of adjacent array elements over the ellipsoid surface may cause an overlap of the respective profiles of such elements, depending of course on which part of the ellipsoid the elements are disposed. This overlap or mutual coupling is manifested as amplitude and phase variations in the composite array pattern and, in general, constitutes an undesirable parasitic effect that is commonly remedied by iterating the spacing among the respective elements without puncturing or creating gaps in the intended complete hemispherical coverage. To counter this effect, the overall dimensions of the ellipsoid array (height and base radius) may therefore be increased while maintaining the number of elements constant. Namely, with a dimensional increase in axes there is also an increased surface area, so that the separation of selected adjacent cells may be increased to counter mutual coupling therebetween.

In addition to increasing the dimensions of the ellipsoid surface to counter mutual coupling among cells, such a change in size may also serve to compensate for the effects of weighting of the peripheral elements. Such weighting is employed to achieve amplitude tapering at the expense of gain in order to reduce the level of sidelobes so as to reduce interference with other equipment. The extent of the dimensional change will depend upon the amount of tapering effected.

In many applications, a system requires two antennas which communicate with each other (e.g. a ground control facility with an airborne platform). Obviously, the mating antenna may possess gain characteristics which vary as a function of elevation or declination. In these cases, it is necessary to change the ratio of the height of the ellipsoid to the radius of the base. This is accomplished by first determining the base radius using the required gain at zenith as explained above. Then the height is determined by using the required gain at the horizon, determining the required vertical illuminated effective surface area, and then determining the height (H) required by the expression:

$$H = \frac{Av}{2\pi r}, \quad (7)$$

Wherein

Av = required vertical illuminated effective surface area and r = determined base radius.

As will be appreciated from the foregoing description of the invention, the distribution of an array of antenna elements in an ellipsoid (hemi-ellipsoid) not only is capable of providing complete hemispherical coverage (and thus especially attractive for air borne communications) but does so with fewer elements and with effectively uniform gain as compared with conventional spherical dome or tetrahedral configurations.

While I have shown and described one embodiment in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

What is claimed is:

1. An antenna comprising:

a curved three dimensional surface having a rate of change of slope which is non uniform over said surface and the projected area of which is substantially uniform hemispherical or near hemispherical; and an array of antenna elements distributed over said three dimensional surface in an arrangement which provides an effective radiation profile corresponding to the projected area of said surface.

2. An antenna according to claim 1, wherein said surface is configured from an ellipse of revolution.

3. An antenna according to claim 2, wherein the length of the major axis of said ellipse of revolution is twice that of its minor axis.

4. An antenna according to claim 1, wherein said surface is in the form of a hemi-ellipse of revolution, the base of which lies in a plane from which said hemispherical coverage is provided.

5. An antenna according to claim 4, wherein the length of the major axis of said hemi-ellipse of revolution is twice that of its minor axis which lies in the base of said hemi-ellipse of revolution.

6. An antenna according to claim 1, wherein said elements are distributed evenly or uniformly over said surface.

7. An antenna according to claim 1, wherein the spacing among selected ones of said elements is such as to prevent or minimize the deleterious effects of mutual coupling between said elements.

8. An antenna according to caim 1, wherein said surface is a surface of revolution.

9. A method of forming an antenna comprising the steps of:

providing a curved three dimensional surface having a rate of change of slope which is non uniform over said surface and the projected area of which is substantially uniform hemispherical or near hemispherical; and distributing, on said three dimensional surface, an array of antenna elements in an arrangement which provides an effective radiation profile corresponding to the projected area of said surface.

10. A method according to claim 9, wherein said three dimensional surface is configured from an ellipse of revolution.

11. A method according to claim 10, wherein the length of the major axis of said ellipse of revolution is twice that of its minor axis.

12. A method according to claim 9, wherein said three dimensional surface is in the form of a hemi-ellipse of revolution, the base of which lies in a plane from which said hemispherical coverage is provided.

13. A method according to claim 12, wherein the length of the major axis of said hemi-ellipse of revolution is twice that of its minor axis which lies in the base of said hemi-ellipse of revolution.

14. A method according to claim 9, wherein said elements are distributed evenly or uniformly over said surface.

15. A method according to claim 9, wherein the spacing among selected ones of said elements is such as to prevent or minimize the deleterious effects of mutual coupling between said elements.

16. A method according to claim 9, wherein said surface is a surface of revolution.

* * * * *